US012102235B1

(12) United States Patent
Luo

(10) Patent No.: US 12,102,235 B1
(45) Date of Patent: Oct. 1, 2024

(54) ANTI-COLLAPSE INFLATABLE AIR MATTRESS

(71) Applicant: Xiaoyao Luo, Bazhong (CN)

(72) Inventor: Xiaoyao Luo, Bazhong (CN)

( * ) Notice: Subject to any disclaimer, the term of this patent is extended or adjusted under 35 U.S.C. 154(b) by 0 days.

(21) Appl. No.: 18/605,886

(22) Filed: Mar. 15, 2024

(51) Int. Cl.
*A47C 27/08* (2006.01)
*A47C 27/00* (2006.01)

(52) U.S. Cl.
CPC ..... *A47C 27/081* (2013.01); *A47C 27/087* (2013.01); *A47C 27/08* (2013.01)

(58) Field of Classification Search
CPC ..... A47C 27/087; A47C 27/081; A47C 27/08
USPC ..... 5/706, 711, 712
See application file for complete search history.

(56) References Cited

U.S. PATENT DOCUMENTS 272,116 A * 2/1883 Blochman et al. .. A47C 27/081 5/712
277,979 A * 5/1883 Blochman et al. .. A47C 27/081 5/644
1,371,919 A * 3/1921 Mahony ..... A47C 27/081 5/710
1,576,211 A * 3/1926 O'Kane ..... A47C 27/081 5/710
1,610,898 A * 12/1926 Steiner ..... A47C 27/081 5/712
2,360,715 A * 10/1944 Perry ..... B60N 2/7052 5/709
2,604,641 A * 7/1952 Reed ..... A47C 27/087 5/710
2,919,747 A * 1/1960 Post ..... A47C 27/081 156/227
4,328,599 A * 5/1982 Mollura ..... A47C 27/088 5/682
4,459,714 A * 7/1984 Lin ..... A47C 27/085 24/DIG. 42
4,541,135 A * 9/1985 Karpov ..... A47C 27/087 5/710
5,561,873 A * 10/1996 Weedling ..... A61G 7/103 5/81.1 R
5,608,931 A * 3/1997 Gancy ..... A47C 27/087 5/711
5,852,839 A * 12/1998 Gancy ..... A47C 27/081 5/706
6,568,011 B2 * 5/2003 Fisher ..... A47C 27/087 5/711

(Continued)

*Primary Examiner* — Robert G Santos
(74) *Attorney, Agent, or Firm* — WPAT, P.C

(57) ABSTRACT

An anti-collapse inflatable air mattress includes an inflatable air mattress body. The inflatable air mattress body includes a top sheet, a side sheet and a bottom sheet. The top sheet, side sheet and bottom sheet define an inflatable cavity. The anti-collapse inflatable air mattress includes at least one elastic support device in the inflatable cavity, an end of the at least one elastic support device is connected to the top sheet, and another end of the at least one elastic support device is connected to the bottom sheet. The at least one elastic support device are two elastic support devices juxtaposed with each other, and each elastic support device includes a spring wire or a spring column. The anti-collapse inflatable air mattress has advantages of reasonable structure, strong practicability, convenient use and safety, and the anti-collapse inflatable air mattress can prevent collapse and prolong the service life.

8 Claims, 3 Drawing Sheets

(56) References Cited

U.S. PATENT DOCUMENTS 7,089,618 B1 * 8/2006 Metzger ..... A47C 27/087 5/709
7,406,735 B2 * 8/2008 Lin ..... A47C 27/081 5/711
7,591,036 B2 * 9/2009 Lin ..... A47C 27/081 5/713
7,636,970 B2 * 12/2009 Lin ..... A47C 27/081 5/713
9,247,827 B2 * 2/2016 Lin ..... A47C 27/081
10,398,235 B2 * 9/2019 Lin ..... A47C 27/10
10,687,633 B2 * 6/2020 Liu ..... A47C 27/087
11,503,920 B1 * 11/2022 Shi ..... A47C 27/10
11,564,505 B2 * 1/2023 Liu ..... A47C 27/16
11,583,099 B2 * 2/2023 Li ..... A47C 27/10
11,937,703 B2 * 3/2024 Shi ..... A47C 27/082
2002/0083528 A1 * 7/2002 Fisher ..... A47C 27/081 5/710
2006/0265810 A1 * 11/2006 Wu ..... A47C 27/081 5/712
2007/0283499 A1 * 12/2007 Lin ..... A47C 27/081 5/713
2008/0209642 A1 * 9/2008 Lin ..... A47C 27/087 5/713
2008/0209643 A1 * 9/2008 Lin ..... A47C 27/081 5/713
2015/0201760 A1 * 7/2015 Lin ..... A47C 27/087 5/710
2016/0183692 A1 * 6/2016 Lin ..... A47C 27/081 5/710
2017/0196368 A1 * 7/2017 Liu ..... A47C 27/16
2017/0215599 A2 * 8/2017 Lin ..... A47C 27/10
2020/0315366 A1 * 10/2020 Liu ..... A47C 27/16
2021/0169232 A1 * 6/2021 Hou ..... A47C 27/087
2022/0202198 A1 * 6/2022 Li ..... A47C 27/087
2023/0029332 A1 * 1/2023 Xia ..... A47C 27/081
2023/0098052 A1 * 3/2023 Shi ..... A47C 27/082 5/706
2023/0320491 A1 * 10/2023 Hou ..... A47C 27/087 5/706
2024/0016303 A1 * 1/2024 Shi ..... A47C 27/082

* cited by examiner

ANTI-COLLAPSE INFLATABLE AIR MATTRESS

TECHNICAL FIELD

The disclosure relates to the field of mattress technology, and more particularly to an anti-collapse inflatable air mattress.

BACKGROUND

Sleep is a foundation of health, in addition to work, life, physical and psychological reasons, healthy bedding with hygiene, comfort, beauty and durability is also a key to obtain high quality sleep. With continuous progresses of material civilization and technology, types of mattresses used by modern people gradually tend to diversify, and are mainly divided into spring mattresses, palm mattresses, latex mattresses, waterbed mattresses, inflatable air mattresses and magnetic mattresses etc.

The inflatable air mattresses include a drawstring inflatable air mattress. The drawstring inflatable air mattress refers to a type of mattress that expands in volume after inflation. The drawstring inflatable air mattress is easy to carry and is popularized.

At present, a connection between a drawstring and a cushion body is prone to breakage, leading to partial collapse of the drawstring inflatable air mattress and shortening its service life, due to a concentrated force at the connection between the drawstring and the cushion body of the drawstring inflatable air mattress.

SUMMARY

The disclosure aims at providing an anti-collapse inflatable air mattress with reasonable structure, great practicality, convenience of use, safety, and ability to prevent mattress collapse and prolong its service life.

To realize above purposes, the disclosure provides the anti-collapse inflatable air mattress. The anti-collapse inflatable air mattress includes an inflatable air mattress body. The inflatable air mattress body includes a top sheet, a side sheet and a bottom sheet. The top sheet, the side sheet and the bottom sheet together define an inflatable cavity. The anti-collapse inflatable air mattress further includes at least one elastic support device disposed in the inflatable cavity, an end of the at least one elastic support device is connected to the top sheet, and another end of the at least one elastic support device is connected to the bottom sheet.

In an embodiment, the at least one elastic support device are two elastic support devices juxtaposed with each other.

In an embodiment, each elastic support device includes a spring wire, a spring column or stretch cotton yarns.

In an embodiment, each elastic support device is the spring wire or the spring column; and each elastic support device is vertically arranged inside the inflatable cavity, an end of each clastic support device is connected to the top sheet, and another end of each elastic support device is connected to the bottom sheet.

In an embodiment, the anti-collapse inflatable air mattress further includes at least one middle partition layer disposed inside the inflatable cavity, an end of the at least one middle partition layer is connected to the top sheet, another end of the at least one middle partition layer is connected to the bottom sheet; and the at least one middle partition layer is disposed on a side of each elastic support device.

In an embodiment, the anti-collapse inflatable air mattress further includes sloping partition layers disposed on a side of the side sheet facing towards the inflatable cavity, an end of one of the sloping partition layers is connected to the top sheet, and another end of the one sloping partition layer is connected to the side sheet; and an end of another of the sloping partition layers is connected to the bottom sheet, and another end of the another sloping partition layer is connected to the side sheet.

In an embodiment, the at least one middle partition layer and/or one of the sloping partition layers defines an air hole.

In an embodiment, the inflatable air mattress body defines an inflation port.

In an embodiment, the inflatable air mattress body defines a motor inflation port disposed on a side of the inflation port.

Beneficial effects of the disclosure are below. The disclosure provides the anti-collapse inflatable air mattress. The anti-collapse inflatable air mattress includes the inflatable air mattress body. The inflatable air mattress body includes the top sheet, the side sheet and the bottom sheet. The top sheet, the side sheet and the bottom sheet together define the inflatable cavity. The at least one elastic support device is disposed in the inflatable cavity, an end of the at least one elastic support device is connected to the top sheet, and another end of the at least one clastic support device is connected to the bottom sheet.

Above structure arrangements make the anti-collapse inflatable air mattress of the disclosure more elastic, safer, more reliable and more convenient to use, and can effectively prevents the anti-collapse inflatable air mattress from collapsing.

The disclosure further includes the at least one middle partition layer and the sloping partition layer. The at least one middle partition layer and the sloping partition layer provide traction to the top sheet, side sheet and bottom sheet, making the anti-collapse inflatable air mattress distribute force to each part of the anti-collapse inflatable air mattress to effectively increase anti-collapse performance. The disclosure has great practicality, reasonable structure, and is suitable for broad promotion and use.

BRIEF DESCRIPTION OF DRAWINGS

To more clearly illustrate technical solutions in embodiments of the disclosure or related art, accompanying drawings used in a description of the embodiments or related art will be briefly introduced below. Apparently, the accompanying drawings in the description below are only some of the embodiments of the disclosure. For those skilled in the art, other accompanying drawings can be obtained according to structures illustrated in the accompanying drawings, without creative labor.

Figure 1:
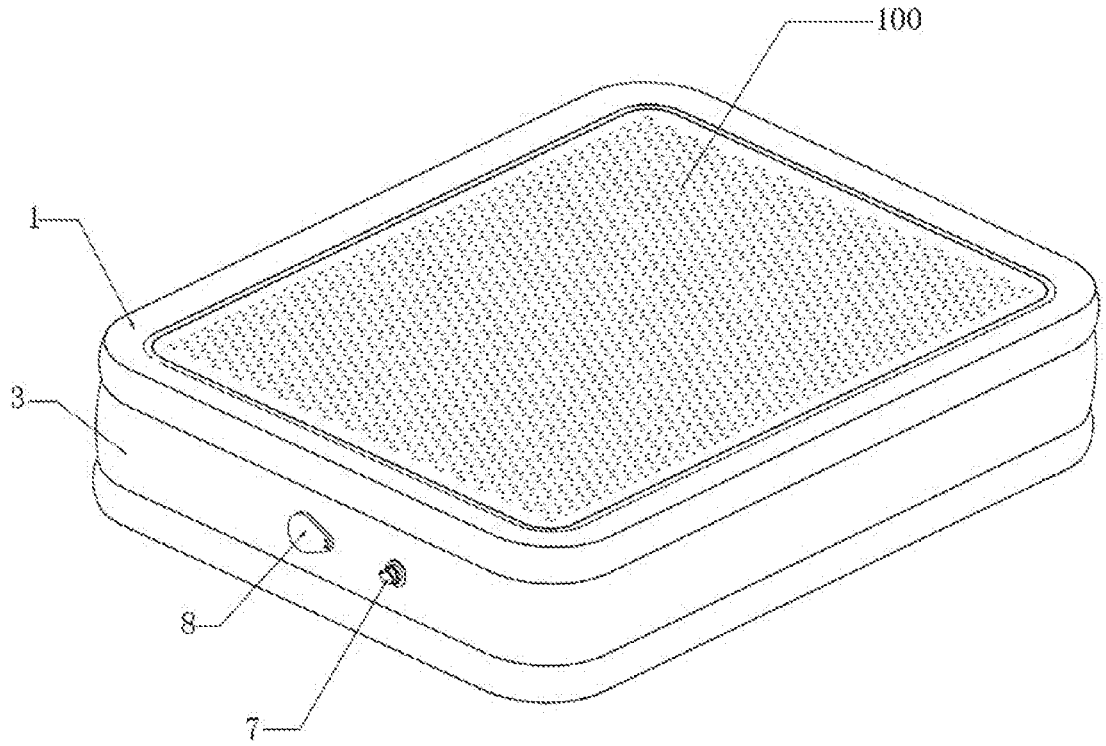
FIG. 1 illustrates a first schematic structural diagram of an anti-collapse inflatable air mattress according to an embodiment of the disclosure.

Purpose realization, functional characteristics, and advantages of the disclosure will be further explained in conjunction with the embodiments, with reference to the accompanying drawings.

DETAILED DESCRIPTION OF EMBODIMENTS

Technical solutions in the embodiments of the disclosure will be described below clearly and completely, in conjunction with accompanying drawings. Apparently, the described embodiments are only a part of the embodiments of the disclosure, and not all of the embodiments. Based on the embodiments of the disclosure, all other embodiments obtained by those skilled in the art without creative labor fall within the protection scope of the disclosure.

It should be noted that all directional indications in the embodiments of the disclosure, such as on, under, left, right, front and behind etc., are only used to explain relative positional relationship and movement among components in a specific attitude as shown in the accompanying drawings. If the specific attitude changes, the directional indications change correspondingly.

In the disclosure, unless otherwise expressly specified and limited, terms, such as "connected" and "fixed" etc., should be understood in a broad sense, for example, "fixed" can be a fixed connection, a detachable connection, or a one-piece connection; can also be a mechanical connection or an electrical connection; can further be a direct connection or an indirect connection through an intermediate medium, and an internal connection of two components or an interaction relationship between two components, unless otherwise specified. For those skilled in the art, specific meanings of above terms in the disclosure can be understood based on specific circumstances.

In addition, if there are descriptions involving "first", "second", etc. in the embodiments of the disclosure, the descriptions of "first", "second", etc. are only used for descriptive purposes and cannot be understood as indicating or implying their relative importance or implying the number of indicated technical features. Therefore, a feature limited as "first" or "second" may include at least one such feature either explicitly or implicitly. Furthermore, the meaning of "add/or" in the disclosure includes three embodiments. "A and/or B", for example, includes an embodiment A, or an embodiment B, or an embodiment that A and B are both satisfied. Furthermore, the technical solutions among various embodiments can be combined with each other, however, must be based on that those skilled in the art can achieve, when a combination of the technical solutions is contradictory or unattainable, it should be considered that the combination of the technical solutions does not exist, and is not included in the protection scope of the disclosure.

The disclosure provides an anti-collapse inflatable air mattress.

Embodiment 1

Referring to FIG. 1 to FIG. 5, in an embodiment of the disclosure, the anti-collapse inflatable air mattress (i.e., the mattress) includes an inflatable air mattress body 100, the inflatable air mattress body 100 includes a top sheet 1, a side sheet 3 and a bottom sheet 2. The top sheet 1, the side sheet 3 and the bottom sheet 2 together define an inflatable cavity 9. The mattress further includes a first elastic support device 41 disposed in the inflatable cavity 9, an end of the first elastic support device 41 is connected to the top sheet 1, and another end of the first elastic support device 41 is connected to the bottom sheet 2.

In the embodiment, the mattress includes two clastic support devices 4, i.e., the first elastic support device 41 and a second elastic support device 42, which are juxtaposed with each other.

In the embodiment, furthermore, the first elastic support device 41 or the second elastic support device 42 includes a spring wire, a spring column or stretch cotton yarns.

In the embodiment, multiple elastic support devices can be disposed inside the inflatable cavity 9 to support the inflatable cavity 9. Upper ends of the first elastic support device 41 and the second elastic support device 42 are connected to a side of the top sheet 1, and bottom ends of the first elastic support device 41 and the second elastic support device 42 are connected to an inside of the bottom sheet 2. The first elastic support device 41 and the second elastic support device 42 make the inflatable air mattress body 100 more stable for use, preventing the mattress from collapsing and deforming, and extending service life of the mattress.

In the embodiment, furthermore, the first elastic support device 41 or the second elastic support device 42 can be made of multiple spring wires, spring columns or stretch cotton yarns, thus making the mattress more stable and preventing the mattress from collapsing and deforming.

In the embodiment, furthermore, the spring wires, spring columns or stretch cotton yarns are disposed in the inflatable cavity 9, an end of each spring wire, spring column or stretch cotton yarn is connected to the top sheet 1, and another end of each spring wire, spring column or stretch cotton yarn is connected to the bottom sheet 2.

In the embodiment, the spring wires, spring columns or stretch cotton yarns are vertically arranged inside the inflatable cavity 9, providing more stable support force and saving cost, thus structure of the disclosure is more reasonable.

Figure 2:
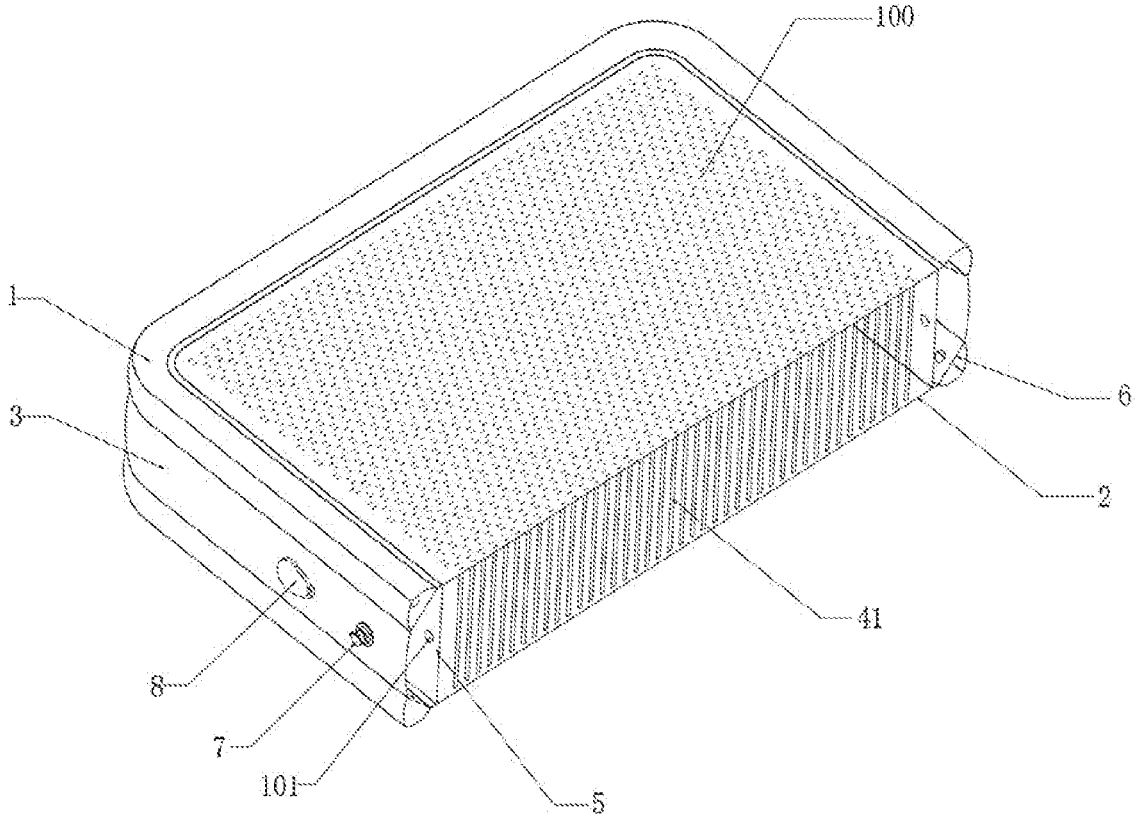
FIG. 2 illustrates a second schematic structural diagram of the anti-collapse inflatable air mattress according to an embodiment of the disclosure.
Figure 3:
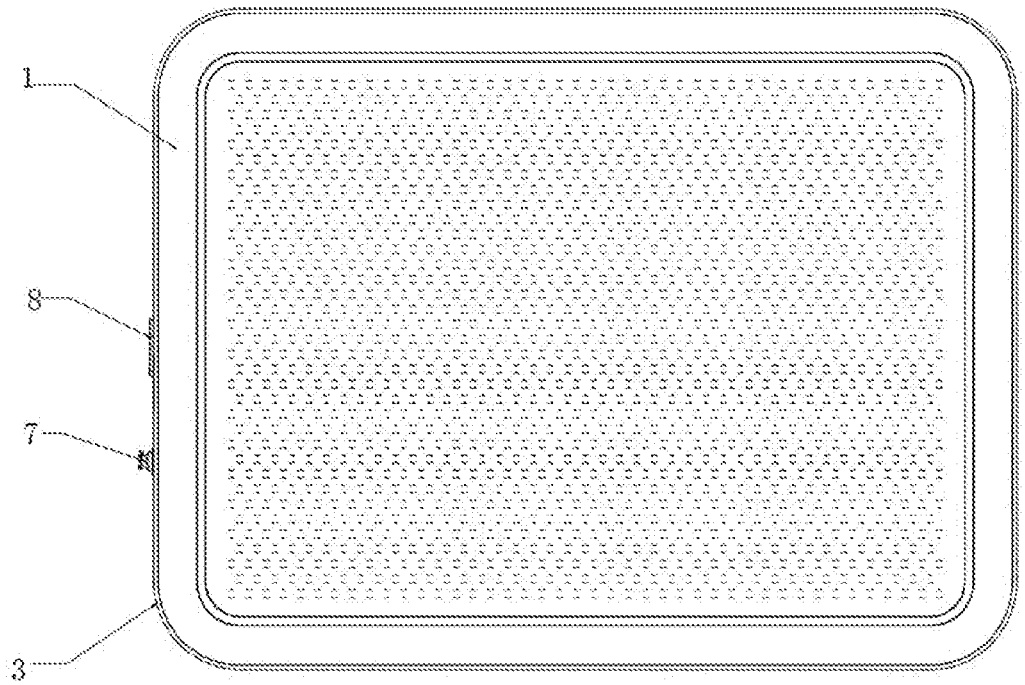
FIG. 3 illustrates a third schematic structural diagram of the anti-collapse inflatable air mattress according to an embodiment of the disclosure.
Figure 4:
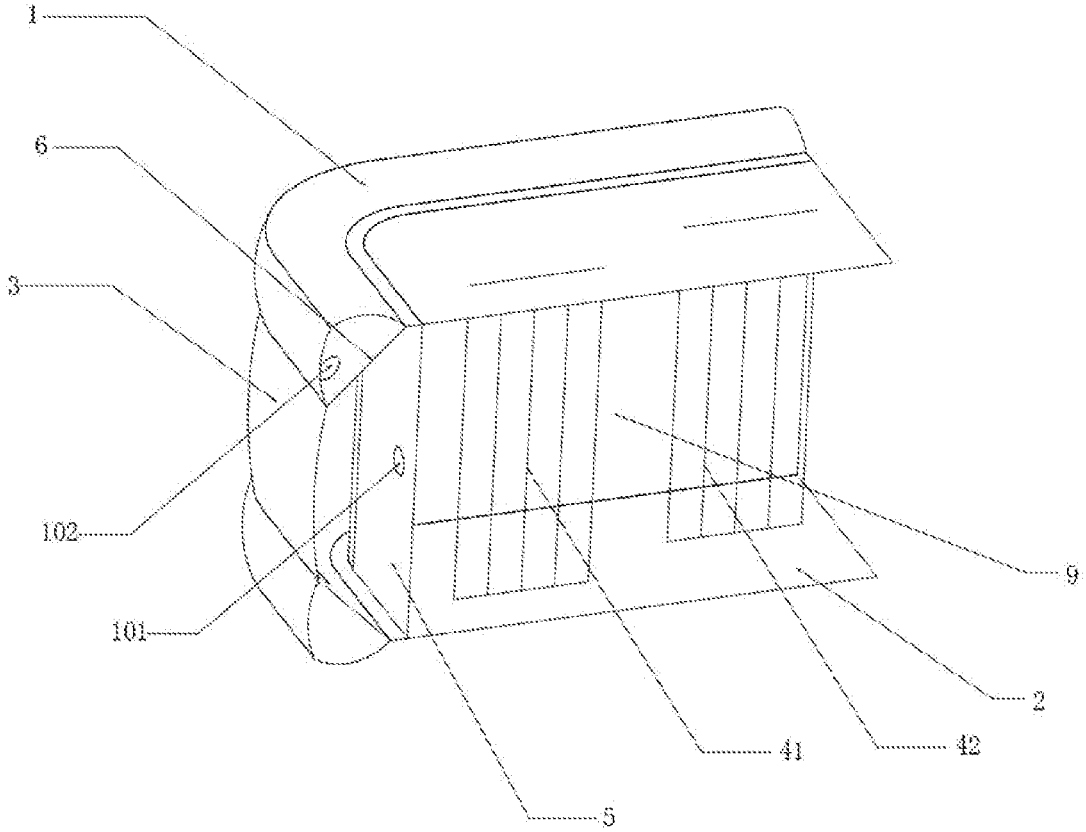
FIG. 4 illustrates a schematic structural diagram of an inflatable cavity according to an embodiment of the disclosure.
Figure 5:
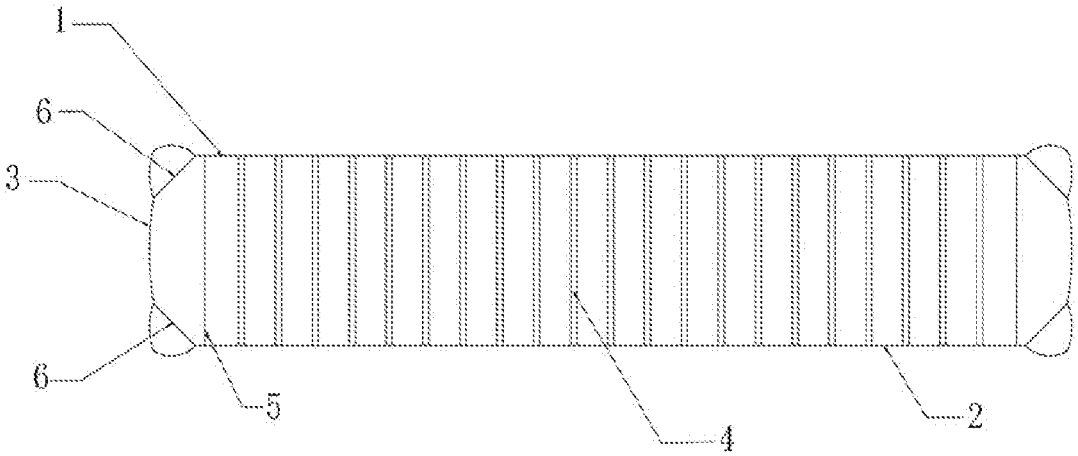
FIG. 5 illustrates a bottom view of the anti-collapse inflatable air mattress in an embodiment of the disclosure.

Referring to FIG. 2, FIG. 4 and FIG. 5, in the embodiment, preferably, the mattress further includes at least one middle partition layer 5 disposed inside the inflatable cavity 9, an end of the at least one middle partition layer 5 is connected to the top sheet 1, another end of the at least one middle partition layer 5 is connected to the bottom sheet 2, and the at least one middle partition layer 5 is disposed on a side of the spring wires, spring columns or stretch cotton yarns.

In the embodiment, furthermore, the mattress includes two middle partition layers 5 disposed inside the inflatable cavity 9, the two middle partition layers 5 are separately disposed on a left side and right side of the first elastic support device 41 and the second elastic support device 42. The two middle partition layers 5 are used to limit activity space of the first elastic support device 41 and the second elastic support device 42, making the first clastic support device 41 and the second elastic support device 42 more stable. In addition, the two middle partition layers 5 provide auxiliary support for the mattress, making the mattress more stable and less prone to deform and collapse.

Referring to FIG. 4 and FIG. 5, in the embodiment, preferably, the mattress further includes sloping partition layers 6 disposed on a side of the side sheet 3 facing towards the inflatable cavity 9, an end of one of the sloping partition layers 6 is connected to the top sheet 1, and another end of the one sloping partition layer 6 is connected to the side sheet 3, and an end of another of the sloping partition layers 6 is connected to the bottom sheet 2, and another end of the another sloping partition layer 6 is connected to the side sheet 3.

In the embodiment, the sloping partition layers 6 are disposed on a side of the side sheet 3 facing towards the inflatable cavity 9, an end of each sloping partition layer 6 is connected to the top sheet 1 or the bottom sheet 2. The sloping partition layers 6 provide traction to the top sheet 1, the side sheet 3 and the bottom sheet 2, making the mattress distribute force to each part of the mattress and increase anti-collapse performance effectively.

Referring to FIG. 1 to FIG. 5, in the embodiment, preferably, the inflatable air mattress body 100 defines an inflation port 7. The inflation port 7 is used for physically inflating and deflating the mattress for convenience.

In the embodiment, furthermore, preferably, the inflatable air mattress body 100 defines a motor inflation port 8 disposed on a side of the inflation port 7.

The motor inflation port 8 is used to inflate or deflate the mattress by an electric inflation motor, making the mattress more convenient to use.

In the embodiment, furthermore, preferably, the middle partition layer 5 defines a first air hole 101, and the sloping partition layer 6 defines a second air hole 102.

In the embodiment, the mattress further includes at least one partition to divide the inflatable cavity 9 into multiple inflatable chambers, the partition defines a third air hole (not shown in figures), furthermore, preferably, the first air hole 101 can be defined on the middle partition layer 5, and the second air hole 102 can be defined on the sloping partition layer 6, making airflow in each inflatable chamber can be better circulated to ensure gas circulation inside the inflatable cavity 9.

The disclosure has reasonable structure and great practicality, making the structure of the mattress more stable and safer, and better preventing the mattress from collapse.

The above is only an optional embodiment of the disclosure, and is not intended to limit the scope of the patent of the disclosure, and any equivalent structural changes made by utilizing the specification and the accompanying drawings of the disclosure under the inventive concept of the disclosure or directly/indirectly applied in the related art are included in the scope of the patent protection of the disclosure.

What is claimed is:

1. An anti-collapse inflatable air mattress, comprising: an inflatable air mattress body;

wherein the inflatable air mattress body comprises: a top sheet, a side sheet and a bottom sheet; the top sheet, the side sheet and the bottom sheet together define an inflatable cavity;

wherein the anti-collapse inflatable air mattress further comprises: at least one elastic support device disposed in the inflatable cavity; and an end of the at least one elastic support device is connected to the top sheet, and another end of the at least one elastic support device is connected to the bottom sheet;

wherein the anti-collapse inflatable air mattress further comprises:

a middle partition layer, disposed inside the inflatable cavity and located at a side of the at least one elastic support device; wherein an end of the middle partition layer is directly connected to the top sheet, and another end of the middle partition layer is directly connected to the bottom sheet; and two sloping partition layers, disposed inside the inflatable cavity; wherein an end of one of the two sloping partition layers is connected to the top sheet, and another end of the one sloping partition layer is connected to the side sheet; and an end of the other sloping partition layer is connected to the bottom sheet, and another end of the other sloping partition layer is connected to the side sheet; and the two sloping partition layers are disposed between the side sheet and the middle partition layer, the end of the one sloping partition layer connected to the top sheet and the end of the middle partition layer connected to the top sheet are spaced apart, and the end of the other sloping partition layer connected to the bottom sheet and the another end of the middle partition layer connected to the bottom sheet are spaced apart;

wherein the side sheet defines an inflation port and a motor inflation port, which are located between the ends of the two sloping partition layers connected with the side sheet.

2. The anti-collapse inflatable air mattress as claimed in claim 1, wherein the at least one elastic support device are two elastic support devices juxtaposed with each other.

3. The anti-collapse inflatable air mattress as claimed in claim 2, wherein each elastic support device comprises a spring wire, a spring column or stretch cotton yarns.

4. The anti-collapse inflatable air mattress as claimed in claim 3, wherein each elastic support device is the spring wire or the spring column; and each elastic support device is vertically arranged inside the inflatable cavity, an end of each elastic support device is connected to the top sheet, and another end of each elastic support device is connected to the bottom sheet.

5. The anti-collapse inflatable air mattress as claimed in claim 1, wherein the at least one middle partition layer and/or one of the sloping partition layers defines an air hole.

6. The anti-collapse inflatable air mattress as claimed in claim 1, wherein the at least one elastic support device comprises: a plurality of spring wires; the plurality of spring wires are directly connected the top sheet, thereby making the top sheet define a plurality of linear patterns; and two of the plurality of linear patterns arranged in a same column in adjacent two rows are aligned, and staggered with two of the plurality of linear patterns located in a same column in other adjacent two rows adjacent to the adjacent two rows; and there are no linear patterns in the other adjacent two rows that are aligned with the two linear patterns in the same column in the adjacent two rows.

7. An anti-collapse inflatable air mattress, comprising:

a top sheet;

a side sheet, connected to the top sheet; wherein the side sheet defines an inflation port and a motor inflation port which are located at a same side of the anti-collapse inflatable air mattress;

a bottom sheet, connected to the side sheet; wherein the top sheet, the side sheet, and the bottom sheet together define an inflatable cavity;

an elastic support device, disposed inside the inflatable cavity and connected between the top sheet and the bottom sheet;

a middle partition layer, disposed inside the inflatable cavity and connected between the top sheet and the bottom sheet; wherein the middle partition layer is located at an outside of the elastic support device; and a sloping partition layer, disposed inside the inflatable cavity and located between the middle partition layer and the side sheet; wherein the sloping partition layer is connected between the top sheet and the bottom sheet;

wherein a number of the sloping partition layer is two; an end of one of the two sloping partition layers is directly connected to the top sheet, and another end of the one sloping partition layer is directly connected to the side sheet; and an end of the other sloping partition layer is directly connected to the bottom sheet, and another end of the other sloping partition layer is directly connected to the side sheet; and the inflation port and the motor inflation port are located between the ends of the two sloping partition layers connected with the side sheet; and wherein the elastic support device comprises: a plurality of spring wires, and the plurality of spring wires are directly connected between the top sheet and the bottom sheet, thereby making the top sheet define multi-row and multi-column linear patterns, in which two linear patterns located in a same column in adjacent two rows are aligned, and staggered with two linear patterns located in a same column in other adjacent two rows adjacent to the adjacent two rows, and there are no linear patterns in the other adjacent two rows that are aligned with the two linear patterns in the same column in the adjacent two rows.

8. The anti-collapse inflatable air mattress as claimed in claim 7, wherein the sloping partition layer and the middle partition layer define air holes, respectively.

* * * * *